United States Patent [19]

Mayer et al.

[11] 4,336,114

[45] Jun. 22, 1982

[54] ELECTRODEPOSITION OF BRIGHT COPPER

[75] Inventors: Linda J. Mayer, Denville; Stephen C. Barbieri, Rutherford, both of N.J.

[73] Assignee: Hooker Chemicals & Plastics Corp., Warren, Mich.

[21] Appl. No.: 247,577

[22] Filed: Mar. 26, 1981

[51] Int. Cl.[3] ..... C25D 3/38

[52] U.S. Cl. ..... 204/52 R

[58] Field of Search ..... 204/52 R, 44, 106

[56] References Cited

U.S. PATENT DOCUMENTS

| | | | |
|---|---|---|---|
| 3,267,010 | 8/1966 | Creutz et al. | 204/52 R |
| 3,328,273 | 6/1967 | Creutz et al. | 204/52 R |
| 3,770,598 | 11/1973 | Creutz | 204/52 R |
| 4,110,176 | 8/1978 | Creutz et al. | 204/52 R |
| 4,272,335 | 6/1981 | Combs | 204/52 R |

*Primary Examiner*—G. L. Kaplan

*Attorney, Agent, or Firm*—Richard P. Mueller; Arthur E. Kluegel

[57] ABSTRACT

A composition and method for electrodepositing ductile, bright, level copper deposits from an aqueous acidic copper plating electrolyte particularly suited for plating electronic circuit boards containing a brightening and leveling amount of a brightening and leveling system comprising (a) a bath soluble substituted phthalocyanine radical, (b) a bath soluble adduct of a tertiary alkyl amine with polyepichlorohydrin, (c) a bath soluble organic divalent sulfur compound, and (d) a bath soluble reaction product of polyethyleneimine and an alkylating agent which will alkylate the nitrogen on the polyethyleneimine to produce a quaternary nitrogen. The electrolyte optionally also contains bath soluble polyether compounds as a supplemental brightening agent.

22 Claims, No Drawings

ELECTRODEPOSITION OF BRIGHT COPPER

BACKGROUND OF THE INVENTION

This invention broadly relates to a composition and process for the electrodeposition of copper, and more particularly, to a composition and method for the electrodeposition of copper from aqueous acidic copper plating baths, especially from copper sulfate and fluoroborate baths. More specifically, the invention relates to the use of a novel brightening and leveling system comprising a mixture of selected compounds to produce a bright, ductile, level copper deposits with good recess brightness on metal substrates, particularly printed wiring boards, over a wide range of bath concentrations and operating current densities.

A variety of compositions and methods have heretofore been used or proposed for use incorporating various additive agents for electrodepositing bright, level, ductile copper deposits from aqueous acidic copper electroplating baths. Typical of such prior art processes and compositions are those described in U.S. Pat. Nos. 3,267,010; 3,328,273; 3,770,598 and 4,110,176 and pending U.S. patent application Ser. No. 122,204, filed Feb. 19, 1980, now U.S. Pat. No. 4,272,335, which are assigned to the same assignee as the present invention. According to the teachings of U.S. Pat. No. 3,267,010, it has been found that bright, level and ductile deposits of copper can be produced from an aqueous acidic copper electroplating bath incorporating therein a bath-soluble polymer of 1,3-dioxolane, preferably in conjunction with supplemental brightening agents including organic sulfide compounds; U.S. Pat. No. 3,328,273 teaches the use of a bath-soluble polyether compound containing at least 6 carbon atoms as a brightening agent, preferably in conjunction with aliphatic polysulfide compounds; U.S. Pat. No. 3,770,598 teaches the use of a bath-soluble reaction product of polyethyleneimine and an alkylating agent to produce a quaternary nitrogen as a brightener, preferably in conjunction with aliphatic polysulfides, organic sulfides and/or polyether compounds; U.S. Pat. No. 4,110,176 teaches the use of a bath-soluble poly (alkanol quaternary ammonium salt) as a brightening agent such as produced from the reaction of a polyalkylenimine with an alkylene oxide; while pending U.S. patent application Ser. No. 122,204 teaches the use of a substituted phthalocyanine radical as a brightening agent in acid copper plating baths, preferably in conjunction with secondary supplemental brightening agents.

While the compositions and methods described in the aforementioned United States patents provide for excellent bright, ductile, and level copper deposits, some difficulty has been encountered in achieving proper leveling over imperfections in the holes of printed wiring boards comprising recessed low current density areas. The novel brightening and leveling system of the present invention is particularly applicable for copper plating of electronic circuitry printed wiring boards in achieving bright, level, ductile deposits which have the unexpected special ability to provide level deposits over imperfections in the apertures of such printed circuitry boards.

SUMMARY OF THE INVENTION

The benefits and advantages of the present invention are achieved by a composition and method for the electrodeposition of copper from aqueous acidic plating baths containing a brightening and leveling amount of a mixture of compounds comprising: (a) a bath soluble substituted phthalocyanine radical; (b) a bath soluble adduct of a tertiary alkyl amine with polyepichlorohydrin; (c) a bath soluble organic divalent sulfur compound; and (d) a bath soluble reaction product of polyethyleneimine and an alkylating agent which will alkylate the nitrogen on the polyethyleneimine to produce a quaternary nitrogen and wherein said alkylating agent is selected from the group consisting of benzyl chloride, allyl bromide, propane sultone, dimethyl sulfate and wherein the reaction temperature ranges from about room temperature to about 120° C.

The electrolyte can further optionally, but preferably contain a brightening amount of a bath soluble polyether compound as a supplemental brightening agent to provide for still further improvements in the leveling and brightness of the copper deposit.

In accordance with the method aspects of the present invention, the aqueous acidic electroplating bath can be operated at temperatures ranging from about 15 up to about 50 degrees C. and current densities ranging from about 0.5 to about 400 amperes per square foot (ASF).

Additional benefits and advantages of the present invention will become apparent upon a reading of the description of the preferred embodiments taken in conjunction with the accompanying examples.

DESCRIPTION OF THE PREFERRED EMBODIMENTS

In accordance with the composition and method aspects of the present invention, aqueous acidic copper plating baths are employed which are either of the acidic copper sulfate or acidic copper fluoroborate type. In accordance with conventional practice, aqueous acidic copper sulfate baths typically contain from about 180 to about 250 grams per liter (g/l) of copper sulfate and about 30 to about 80 g/l of sulfuric acid. Acidic copper fluoroborate baths in accordance with prior art practice typically contain from about 150 to about 600 g/l copper fluoroborate and up to about 60 g/l of fluoroboric acid. It has been found that aqueous acidic plating baths of the foregoing types incorporating the brightening agents of the present invention can be operated under conditions of high acid and low copper content. Accordingly, even when such baths contain as little as about 7.5 g/l copper and as much as 350 g/l sulfuric acid or 350 g/l of fluoroboric acid, excellent plating results are still obtained.

In accordance with the method aspects of the present invention, the acidic copper plating baths of the present invention are typically operated at current densities ranging from about 10 to about 100 ASF although current densities as low as about 0.5 ASF to as high as about 400 ASF can be employed under appropriate conditions. Preferably, current densities of about 10 to about 50 ASF are employed. In plating conditions in which high agitation is present, higher current densities ranging up to about 400 ASF can be employed and for this purpose air agitation, cathode-rod agitation and/or solution agitation may be employed.

The operating temperature of the plating baths may range from about 15 degrees C. to as high as about 50 degrees C., with temperatures of about 21 degrees C. to about 36 degrees C. being typical.

The aqueous acidic bath also desirably contains halide ions such as chloride and/or bromide anions, which are typically present in amounts not in excess of about 0.5 g/l.

In addition to the foregoing constituents, the acid copper plating bath of the present invention contains a novel brightening and leveling system comprised of a controlled mixture of selected compounds present in an amount to provide brightening and leveling of the copper electrodeposit. The brightening and leveling system comprises a mixture of: (a) a bath soluble substituted phthalocyanine radical; (b) a bath soluble adduct of a tertiary alkyl amine with polyepichlorohydrin; (c) a bath soluble organic divalent sulfur compound; and (d) a bath soluble reaction product of polyethyleneimine and an alkylating agent which will alkylate the nitrogen on the polyethyleneimine to produce a quaternary nitrogen and wherein said alkylating agent is selected from the group consisting of benzyl chloride, allyl bromide, propane sultone, dimethyl sulfate and wherein the reaction temperature ranges from about room temperature to about 120° C.

Constituent (a) of the brightening and leveling system comprises a substituted phthalocyanine radical of the structural formula:

$$Pc—(X)_n$$

Wherein:

Pc is a phthalocyanine radical;

X is $—SO_2NR_2$, $—SO_3M$, $—CH_2SC(NR_2)_2{}^+Y^-$;

R is H, alkyl containing 1–6 carbon atoms, aryl containing 6 carbon atoms, aralkyl containing 6 carbon atoms in the aryl portion and 1 to 6 carbon atoms in the alkyl portion, heterocyclic containing 2 to 5 carbon atoms and at least 1 nitrogen, oxygen, sulfur or phosphorus atom, and alkyl, aryl, aralkyl and heterocyclic, as defined above, containing 1 to 5 amino, hyroxy, sulfinic or phosphonic groups;

n is an integer of from 1 to 6;

Y is halogen or alkyl sulfate containing 1 to 4 carbon atoms in the alkyl portion; and M is H, Li, Na, K or Mg Compounds of the foregoing structural formula suitable for use are further characterized as having a bath solubility of at least about 0.1 milligrams per liter (mg/l). The phthalocyanine radical may be metal-free or may contain a stable divalent or trivalent metal bound by coordination of the isoindole nitrogen atoms of the molecule, which metal is selected from the group consisting of cobalt, nickel, chromium, iron or copper, as well as mixtures of these, of which copper is the more typical and preferred metal. In this latter regard, it is intended to mean that the brightening agent may be made up of a mixture of substituted phthalocyanine compounds which contain the same or different metals from the group.

The substituted phthalocyanine compound which can be satisfactorily employed in the practice of the present invention is one having a bath solubility of at least about 0.1 milligram per liter (mg/l) which corresponds to the structural formula:

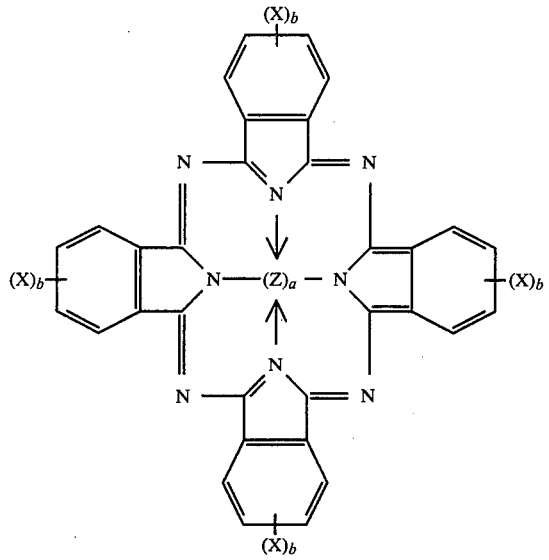

Wherein:

X is as been heretofor defined;

Z is Ni, Co, Cr, Fe or Cu;

a is 0–1; and b is 0–2, provided however that the total number of X substituents is 1–6

Phthalocyanine compounds in accordance with the foregoing structural formula and their methods of preparation are well known in the art. Exemplary of these is the review in Rodds Chemical Carbon Compounds, 2nd Edition 1977, Vol. 4B, pages 334–339 and under Colour Index Number 74280 by the Society of Dyers and Colourers, England and the references cited therein.

A specifically preferred phthalocyanine compound which falls with the foregoing is Alcian Blue which has the following structural formula:

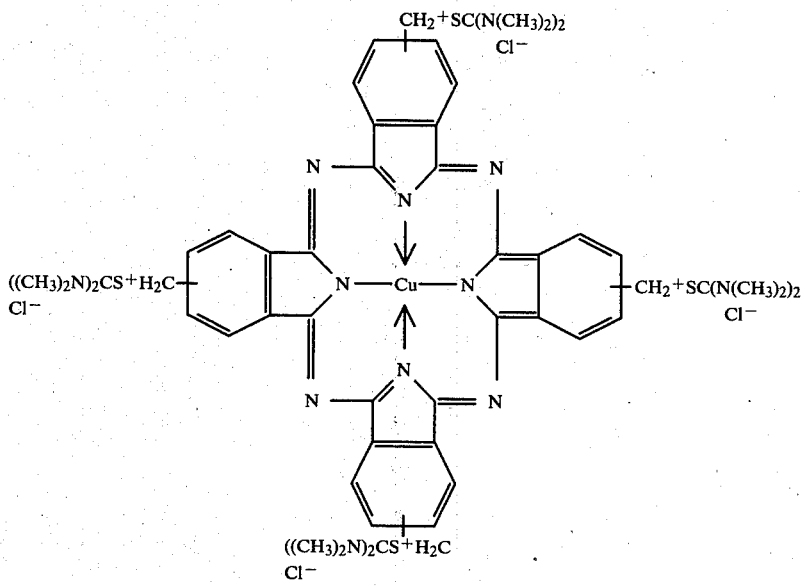

Typically, Alcian Blue may be prepared by reacting copper phthalocyanine with formaldehyde in the presence of $AlCl_3$ and HCl and then reacting the resulting product with N-tetramethylthiourea to form the Alcian Blue.

The phthalocyanine brightening agent is employed in the acidic copper plating bath in a brightening amount which may be as low as about 0.1 mg/l to concentrations as high as about 10 g/l, with amounts ranging from about 2 to about 60 mg/l being preferred for most plating situations. The incorporation of the phthalocyanine brightening agent provides for improved leveling and brightening of the electrodeposited copper particularly in recess areas of parts being electroplated.

Constituent (b) of the brightening and leveling system comprises a bath soluble adduct of a tertiary alkyl amine with polyepichlorohydrin corresponding to the general structural formula:

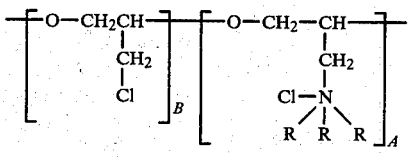

wherein:

R is the same or different and is methyl or ethyl,

A and B are integers whose sum is an integer of from 4 to about 500, and

A:B is at least about 1:5

The polyquaternary amines of the foregoing structural formula may have molecular weights ranging from about 600 to about 100,000 and are selected so as to be soluble in the aqueous acidic electrolyte. Such quaternary adducts of polyepichlorohydrin with tertiary alkyl amines can conveniently be prepared by contacting a polyepichlorohydrin with a solution of a tertiary alkyl amine in a suitable solvent at temperatures of from about 50° C. to about 120° C., preferably at a temperature of about 100° C. Solvents suitable are water and alcohol and the reaction is preferably performed in the presence of vigorous agitation for a period of from about 2 to about 8 hours or more. When amines such as trimethylamine, for example, are employed which are of relatively high volatility, the reaction is carried out in a closed vessel such as an autoclave under pressure. On the other hand, amines of higher boiling point, such as triethylamine, for example, the reaction can be carried out at atmospheric pressure under reflux. In either event, the quaternary adduct product can be separated from the reaction mixture by distilling off the solvent and any unreacted amine.

The preparation and characteristics of such quaternary adducts and the characteristics thereof is more fully described in U.S. Pat. No. 3,320,317 granted May 16, 1967 to which reference is made for further details of such products useable in accordance with the present brightening and leveling system.

The quaternary adduct is employed in the aqueous acid copper electrolyte in amounts ranging from as low as about 0.1 up to concentrations as high as about 1000 mg/l, with amounts ranging from about 3 to about 12 mg/l being preferred for most electronic circuit board plating operations.

The third essential constituent of the brightening and leveling system of the present invention comprises organic divalent sulfur compounds including sulfonated or phosphonated organic sulfides, i.e., organic sulfide compounds carrying at least one sulfonic or phosphonic group. These organic sulfide compounds containing sulfonic or phosphonic groups may also contain various substituting groups, such as methyl, chloro, bromo, methoxy, ethoxy, carboxy or hydroxy, on the molecules, especially on the aromatic and heterocyclic sulfide-sulfonic or phosphonic acids. These organic sulfide compounds may be used as the free acids, the alkali metal salts, organic amine salts, or the like. Exemplary of specific sulfonate organic sulfides which may be used are those set forth in Table I of U.S. Pat. No. 3,267,010, and Table III of U.S. Pat. No. 4,181,582, as well as the phosphonic acid derivatives of these. Other suitable organic divalent sulfur compounds which may be used include $HO_3P—(CH_2)_3—S—S—(CH_2)_3—PO_3H$, as well as mercaptans, thiocarbamates, thiolcarbamates, thioxanthates, and thiocarbonates which contain at least one sulfonic or phosphonic group.

A particularly preferred group of organic divalent sulfur compounds are the organic polysulfide compounds. Such polysulfide compounds may have the formula $XR_1—(S)_nR_2SO_3H$ or $XR_1—(S)_nR_2PO_3H$ wherein $R_1$ and $R_2$ are the same or different alkylene group containing from about 1 to 6 carbon atoms, X is hydrogen $SO_3H$ or $PO_3H$ and n is a number from about 2 to 5. These organic divalent sulfur compounds are aliphatic polysulfides wherein at least two divalent sulfur atoms are vicinal and wherein the molecule has one or two terminal sulfonic or phosphonic acid groups. The alkylene portion of the molecule may be substituted with groups such as methyl, ethyl, chloro, bromo, ethoxy, hydroxy, and the like. These compounds may be added as the free acids or as the alkali metal or amine salts. Exemplary of specific organic polysulfide compounds which may be used are set forth in Table I of column 2 of U.S. Pat. No. 3,328,273 and the phosphonic acid derivatives of these.

Desirably, these organic sulfide compounds are present in the plating baths of the present invention in amounts within the range of about 0.0005 to 1.0 grams per liter, preferably, about 15 to about 60 mg/l.

The fourth essential constituent of the brightening and leveling system comprising part (d) is a bath soluble reaction product of polyethyleneimine and an alkylating agent which will alkylate the nitrogen on the polyethyleneimine to produce a quaternary nitrogen. The alkylating agent is selected from the group consisting of benzyl chloride, allyl bromide, propane sultone, dimethyl sulfate or the like. The reaction temperature to produce the product conventionally ranges from about room temperature to about 120° C. A particularly satisfactory reaction product for use in the brightening and leveling system comprises the product of polyethyleneimine with benzyl chloride. The reaction product (d) can be employed in amounts ranging from about 0.1 to about 50 mg/l, with amounts of from about 0.75 to about 3 mg/l being particularly preferred for the electroplating of electronic circuit boards.

The reaction product, method of synthesis, and suitable alkylating groups are more fully described in U.S. Pat. No. 3,770,598 the substance of which is incorporated herein by reference and to which further reference is made for additional details of satisfactory reaction products for use in accordance with the present invention.

In addition to the four component brightening and leveling system, it has also been found optional but preferable to further include as a supplemental brightening agent, a bath soluble polyether compound to further enhance the properties of the copper electrodeposit. The most preferred polyethers are those containing at least six ether oxygen atoms and having a molecular weight of from about 150 to 1 million. Of the various polyether compounds which may be used, excellent results have been obtained with the polypropylene polyethylene and glycols including mixtures of these, of average molecular weight of from about 600 to 4,000, and alkoxylated aromatic alcohols having a molecular weight of about 300 to 2500. Exemplary of the various preferred polyether compounds which may be used are those set forth hereinafter in Table I. Desirably, the plating baths of the present invention contain these polyether compounds in amounts within the range of about 0.001 to 5 grams per liter, with the lower concentrations generally being used with the higher molecular weight polyethers. Typically, the polyether compounds, when used, are employed in a range of about 10 to about 40 mg/l.

TABLE I

| POLYETHERS | | |
|---|---|---|
| 1. | Polyethylene glycols | (Ave. M.W. of 400–1,000,000) |
| 2. | Ethoxylated naphthols | (Containing 5–45 moles ethylene oxide groups) |
| 3. | Propoxylated naphthols | (Containing 5–25 moles of propylene oxide groups) |
| 4. | Ethoxylated nonyl phenol | (Containing 5–30 moles of ethylene oxide groups) |
| 5. | Polypropylene glycols | (Ave. M.W. of 350–1,000) |
| 6. | Block polymers of polyoxyethlyene and polyoxypropylene glycols | (Ave. M.W. of 350–250,000) |
| 7. | Ethoxylated phenols | (Containing 5–100 moles of ethylene oxide groups) |
| 8. | Propoxylated phenols | (Containing 5–25 moles of propylene oxide groups) |
| 9. | $HO(C_2H_4O)_{5-100}C_2H_4O—C(CH_3)_2—C≡C—C(CH_3)_2—C—OC_2H_4(OC_2H_4)_{5-100}OH$ | |
| 10. | $HO(C_2H_4O)_{5-100}C_2H_4O—C(CH_3)(C_2H_5)—C≡C—C(C_2H_5)—OC_2H_4(OC_2H_4)_{5-100}OH$ | |

TABLE I-continued

| POLYETHERS | | |
|---|---|---|
| 11. | 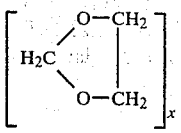 | Where X-4 to 375 and the Ave. M.W. is 320–30,000 |

In order to further illustrate the improved aqueous acidic copper bath composition and method of the present inventions, the following examples are provided. It will be understood that the examples are provided for illustrative purposes and are not intended to be limiting of the scope of the present invention as herein described and as set forth in the subjoined claims.

EXAMPLE 1

Particularly satisfactory electrolytes in accordance with a preferred practice of the present invention for copper plating electronic circuit boards are set forth below:

| INGREDIENT | CONCENTRATION RANGE |
|---|---|
| $CuSO_4 \cdot 5H_2O$ | 60–75 g/l |
| $H_2SO_4$ | 150–225 g/l |
| $Cl^-$ | 20–100 mg/l |
| Methic Turquoise | 7–18 mg/l |
| Quaternized Polyepichlorohydrin | 5–14 mg/l |
| Divalent Sulfur compound | 26–63 mg/l |
| Polybenzylethyleneimine | 1.5–3 mg/l |
| Polyether | 15–40 mg/l |

The chloride ions in the electrolyte set forth above are introduced by way of hydrochloric acid. The polyether compound comprises Carbowax 4000 and the divalent sulfur compound comprises:

$$NaSO_3(CH_3)_2—S—S—(CH_3)_2—SO_3—Na$$

The foregoing bath containing the constituents within the concentration ranges specified produce bright, level and ductile copper deposits over current density ranges preferably from about 10 to about 50 ASF with 30 ASF being particularly satisfactory. Such copper deposits have the particular ability to level over imperfections in the holes of printed circuit boards.

EXAMPLE 2

An electrolyte is prepared containing:

| INGREDIENT | CONCENTRATION |
|---|---|
| $CuSO_4 \cdot 5H_2O$ | 67.5 g/l |
| $H_2SO_4$ | 172.5 g/l |
| $Cl^-$ | 70 mg/l |
| Methic turquoise | 8 mg/l |
| Quaternized Polyepichlorohydrin | 6 mg/l |
| Divalent sulfur compound | 32 mg/l |
| Polybenzylethyleneimine | 1.5 mg/l |
| Carbowax 4000 | 20 mg/l |

A 2 inch by 2 inch printed circuit board is cleaned and water rinsed and then plated in the foregoing electrolyte for a period of 30 minutes at a current density of 30 ASF using air agitation and an electrolyte temperature of 22° C. The resultant copper plated circuit board is characterized as having a bright copper deposit with good leveling and ductility.

While it will be apparent that the invention herein disclosed is well calculated to achieve the benefits and advantages as hereinabove set forth, it will be appreciated that the invention is susceptible to modification, variation and change without departing from the spirit thereof.

What is claimed is:

1. In an aqueous acidic electrolyte containing copper in an amount sufficient to electrodeposit copper on a substrate, the improvement comprising incorporating in the electrolyte a brightening and leveling system in an amount sufficient to produce a bright and level copper deposit comprising a mixture of:

(a) A bath soluble substituted phthalocyanine radical, (b) A bath soluble adduct of a tertiary alkyl amine with polyepichlorohydrin, (c) a bath soluble organic divalent sulfur compound, and (d) a bath soluble reaction product of polyethyleneimine and an alkylating agent which will alkylate the nitrogen on the polyethyleneimine to produce a quaternary nitrogen and wherein said alkylating agent is selected from the group consisting of benzyl chloride, allyl bromide, propane sultone, dimethyl sulfate and wherein the reaction temperature ranges from about room temperature to about 120° C.

2. The electrolyte as defined in claim 1 in which said brightening and leveling system further includes:

(e) a bath soluble polyether compound as a supplemental brightener.

3. The electrolyte as defined in claim 2 in which (e) is present in an amount up to about 5 g/l.

4. The electrolyte as defined in claim 2 in which (e) is present in an amount of about 10 to about 40 mg/l.

5. The electrolyte as defined in claim 1 in which (a) corresponds to the structural formula:

$$Pc—(X)_n$$

Wherein:

Pc is a phthalocyanine radical;

X is $—SO_2NR_2$, $—SO_3M$, $—CH_2SC(NR_2)_2{+}Y^-$;

R is H, alkyl containing 1–6 carbon atoms, aryl containing 6 carbon atoms, aralkyl containing 6 carbon atoms in the aryl portion and 1 to 6 carbon atoms in the alkyl portion, heterocyclic containing 2 to 5 carbon atoms and at least 1 nitrogen, oxygen, sulfur or phosphorus atom, and alkyl, aryl, aralkyl and heterocyclic, as defined above, containing 1 to 5 amino, hyroxy, sulfonic or phosphonic groups;

n is 1–6;

Y is halogen or alkyl sulfate containing 1 to 4 carbon atoms in the alkyl portion; and M is H, Li, Na, K or Mg; said compound having a bath solubility of at least 0.1 mg/l.

6. The electrolyte as defined in claim 1 in which (a) is a metal-free radical.

7. The electrolyte as defined in claim 1 in which (a) is a stable metal-containing phthalocyanine radical.

8. The electrolyte as defined in claim 7 in which (a) contains a divalent or trivalent metal selected from the group consisting of cobalt, nickel, chromium, iron, copper and mixtures thereof, 9. The electrolyte as defined in claim 7 in which (a) contains the metal copper.

10. The electrolyte as defined in claim 1 in which (a) is present in an amount of about 0.1 mg/l to about 10 g/l.

11. The electrolyte as defined in claim 1 in which (a) is present in an amount of about 2 to about 60 mg/l.

12. The electrolyte as defined in claim 1 in which (b) corresponds to the structural formula:

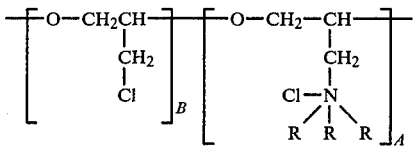

Wherein:

R is the same or different and is methyl or ethyl,

A and B are integers whose sum is an integer of from 4 to about 500, and A:B is at least about 1:5.

13. The electrolyte as defined in claim 1 in which (b) is present in an amount of about 0.6 to about 1000 mg/l.

14. The electrolyte as defined in claim 1 in which (b) is present in an amount of about 3 to about 12 mg/l.

15. The electrolyte as defined in claim 1 in which (c) is an organic polysulfide compound.

16. The electrolyte as defined in claim 15 in which (c) corresponds to the structural formula:

$XR_1—(S)_nR_2SO_3H$, or $XR_1(S)_nR_2PO_3H$

Wherein:

$R_1$ and $R_2$ are the same or different alkylene group containing from 1 to 6 carbon atoms, X is H, $SO_3H$ or $PO_3H$, and n is an integer from 2 to 5.

17. The electrolyte as defined in claim 1 in which (c) is present in an amount of about 0.0005 to about 1 g/l.

18. The electrolyte as defined in claim 1 in which (c) is present in an amount of about 15 to about 60 mg/l.

19. The electrolyte as defined in claim 1 in which (d) is polybenzylethyleneimine.

20. The electrolyte as defined in claim 1 in which (d) is present in an amount of about 0.1 to about 50 mg/l.

21. The electrolyte as defined in claim 1 in which (d) is present in an amount of about 0.75 to about 3 mg/l.

22. A method for electrodepositing a bright copper plating on a substrate which comprises the steps of electrodepositing copper from an aqueous acidic electrolyte at a temperature of about 15° to about 50° C. of a composition as defined in claim 1, 2, 5, 6, 7, 8, 9, 10, 11, 12, 13, 14, 15, 16, 17, 18, 19, 20, 21, 3 or 4.

* * * * *